United States Patent [19]

Burnell et al.

[11] 4,413,852

[45] Nov. 8, 1983

[54] WINDOW SECURITY DEVICE

[76] Inventors: Elvin W. Burnell, McClain Rd., R.D. 5, Ashland, Ohio 44805; David Deschner, 563 Highland Ave., Mansfield, Ohio 44903

[21] Appl. No.: 354,509

[22] Filed: Mar. 3, 1982

[51] Int. Cl.[3] ..... E05C 9/18

[52] U.S. Cl. ..... 292/259

[58] Field of Search ..... 292/259, 262, 302, 338

[56] References Cited

U.S. PATENT DOCUMENTS

| | | | |
|---|---|---|---|
| 2,130,216 | 1/1938 | Zaninovich | 292/259 |
| 2,163,206 | 6/1939 | Lopez | 292/259 |
| 3,698,754 | 10/1972 | Means | 292/262 |
| 3,809,417 | 5/1974 | Craig | 292/259 |
| 4,082,332 | 4/1978 | Palmer | 292/259 |
| 4,179,999 | 12/1979 | Cotton | 292/259 R X |
| 4,262,503 | 4/1981 | Kuebler | 70/101 |

*Primary Examiner*—Richard E. Moore

*Attorney, Agent, or Firm*—Pearne, Gordon, Sessions, McCoy, Granger & Tilberry

[57] ABSTRACT

A security device for a window or other opening in a wall structure, such as a basement window, for preventing unauthorized entry therethrough. The device has an extensible bar adapted to extend across the window from side to side, and which is pivotable about one end between an initial position extending outwardly from the wall structure and a security position extending across the window. The device includes a locking bracket adapted for mounting on the wall structure adjacent the window or on the window frame itself and means such as a combination lock for releasably securing the other end of the bar thereto. On the opposite side of the window is a pivot bracket, also mounted on the wall structure or on the window frame and adapted to receive the pivot end of the bar. The bar is pivotally connected to the pivot bracket by a removable pivot pin that cannot be removed when the bar is locked at its other end to the locking bracket. The pivot bracket includes an interference plate or flange that blocks removal of the pivot pin when the bar is in its security position to prevent unauthorized disconnection of the bar but which has an opening or slot formed therein such that the pivot pin may be removed when the bar is unfastened at its locking end and pivoted back to its initial position.

7 Claims, 3 Drawing Figures

WINDOW SECURITY DEVICE

BACKGROUND OF THE INVENTION

This invention relates to security devices for preventing unauthorized entry through windows or the like in exterior walls of buildings. More particularly, the invention relates to a locking bar that may be used alone or with other similar bars to extend across the window or the like and prevent entry even though the window glass may be broken by a prospective intruder. The device of the invention is particularly adapted for use in connection with basement windows in homes where a single bar is sufficient to prevent unauthorized entry; however, the invention is not limited to that specific application.

Security bars for doors and windows, especially those formed of glass, are often used to prevent an intruder from entering a dwelling or other building by breaking the glass either sufficiently to permit entry therethrough or sufficiently to permit release of the latching device. Examples of prior art devices in this field are shown in the following U.S. patents:

U.S. Pat. No. 2,130,216
U.S. Pat. No. 3,698,754
U.S. Pat. No. 3,809,417
U.S. Pat. No. 4,082,332
U.S. Pat. No. 4,262,503.

While these locking bars are effective in many circumstances, they all have weaknesses that are vulnerable to the skill of a prospective intruder.

For example, while many are secured with a combination lock, padlock, or other positive locking device, they may be defeated if window glass is broken or otherwise removed sufficiently to enable a prospective intruder to disconnect one end of the bar or the other. For example, none of the devices shown would prevent an intruder from gaining entry through a basement window if the intruder broke the window glass and then mechanically disconnected the unlocked en or pivot end, for example, of the security bar.

It should be noted that none of the prior art devices shown in the patents listed above nor the device of the present invention is designed to prevent destructive procedures for defeating the security bar, such as, for example, a hack saw or other metal cutting means. Such means are not within the scope of security provided by the invention, but it will be understood that the majority of prospective intruders would be deterred from attempting to gain entry if the entry required such destructive and time-consuming procedures.

Accordingly, the security device of the present invention is adapted to assure against mechanical disconnection of the bar by a prospective intruder and to afford other features and advantages heretofore not obtainable from the prior art.

SUMMARY OF THE INVENTION

It is among the objects of the invention to prevent unauthorized entry through a window or the like in an exterior wall structure where the window or the like is formed of glass or other material that can be easily broken by a prospective intruder.

Another object is to provide a locking-bar-type security device for a window that cannot be mechanically disconnected at one side of the window or the other.

Still another object is to provide a locking bar especially adapted for use in connection with basement windows to prevent unauthorized entry therethrough, even though an attempt be made to mechanically disconnect the device after breaking the window.

These and other objects and advantages are achieved by the novel security device of the invention, which comprises an extensible bar adapted to extend across the window and which is pivotable about one end between an initial position extending outwardly from the wall structure and a security position extending parallel to the wall structure. A locking bracket is mounted on the wall structure on one side of the window and the respective end of the bar is positively secured to the locking bracket by a locking device such as a combination lock. Across the window from the locking bracket is a pivot bracket, also mounted on the wall structure and adapted to receive the pivot end of the bar. A removable pivot pin pivotally connects the respective pivot end of the bar to the bracket, and an interference means, such as a plate or flange, blocks removal of the pivot pin when the bar is in its security position. When the bar, however, is pivoted to its initial position, an opening or slot in the interference means is brought into alignment with the pin to permit removal of the pin as desired when the bar is disconnected at the locking bracket and then pivoted back to its initial position.

DESCRIPTION OF THE PREFERRED EMBODIMENT

Figure 1:
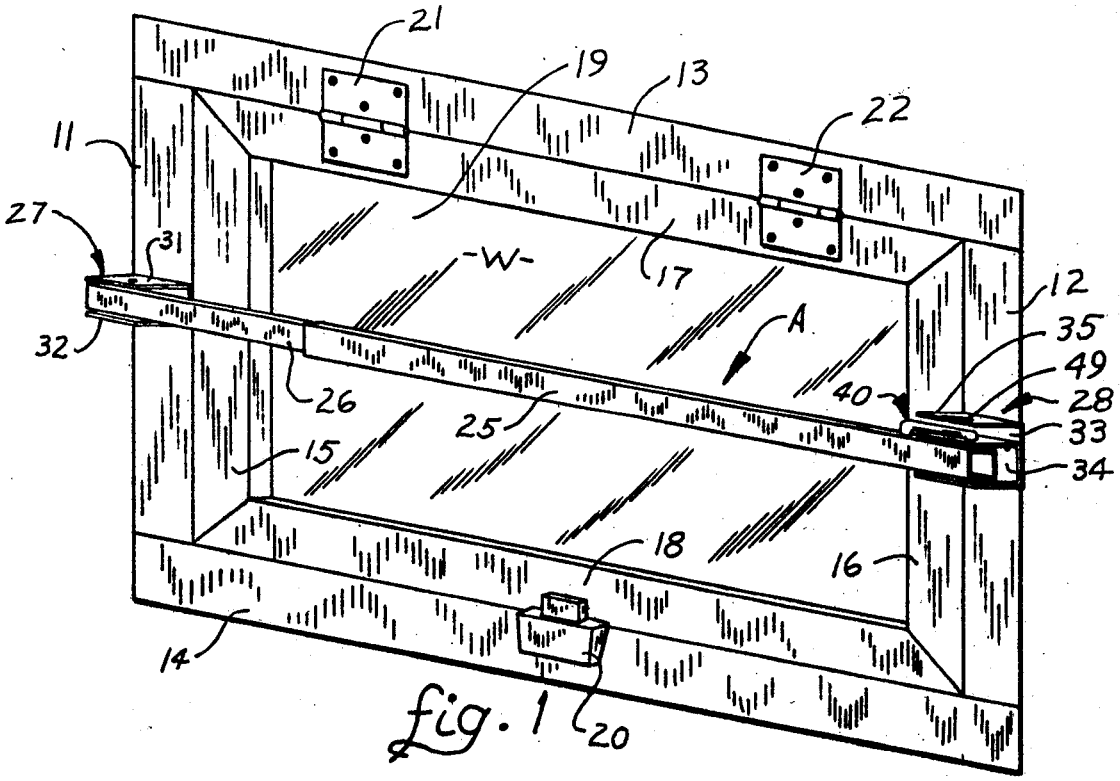
FIG. 1 is a perspective view, showing a security device embodying the invention, used to secure a typical basement window.

Referring more particularly to the drawings, there is shown a window security device A adapted to prevent unauthorized entry through a basement window W. The basement window W is mounted between vertical frame members 11 and 12 on opposite sides thereof, a top frame member 13, and a bottom frame member 14. The window itself includes vertical side members 15 and 16, a top frame member 17, and a bottom frame member 18, in which the pane 19 of window glass is mounted in accordance with standard practices that will be familiar to those skilled in the art.

The window is pivotally connected to the top frame member 13 by hinges 21 and 22 to permit the window to be opened when desired.

The window may be locked in its closed position by a conventional latch mechanism 20 mounted on the lower frame member 14 and the lower frame member 18 of the window. It will be noted, however, that by breaking the window glass, the latch 20 may be easily opened by a prospective intruder.

The device A of the invention comprises a security bar including extensible telescoping tubular members 25 and 26, both being formed of metal of high strength and durability, such as steel, and being telescoped one with the other to permit adjustment thereof, as required in accordance with the width of the window to be secured. While the security bar shown is of square cross section, it will be apparent that bars of a circular cross section or otherwise may also be used with equal results. The smaller bar member 26 is secured at one end to the vertical frame member 11 by means of a locking bracket 27 and the larger bar member 25 is secured at one end to a pivot bracket assembly 28.

The locking bracket 27 comprises upper and lower flanges 31 and 32, which are adapted to receive the respective end of the tubular bar member 26 therebetween. A locking device, such as a combination lock, is used to securely connect the bar member 26 to the bracket 27 by extending through aligned holes in the flanges 31 and 32 and through matching holes in the tubular bar member 26. It will be noted that in this way, the locking device (not shown) not only locks the end of the bar member 26 to the bracket 27 but also prevents extension or retraction of the bar members 25 and 26 considering similar retention of the opposite end of the larger tubular bar member 25. Also, this construction prevents removal of the screws that secure the bracket 27 to the frame member 11.

Figure 2:
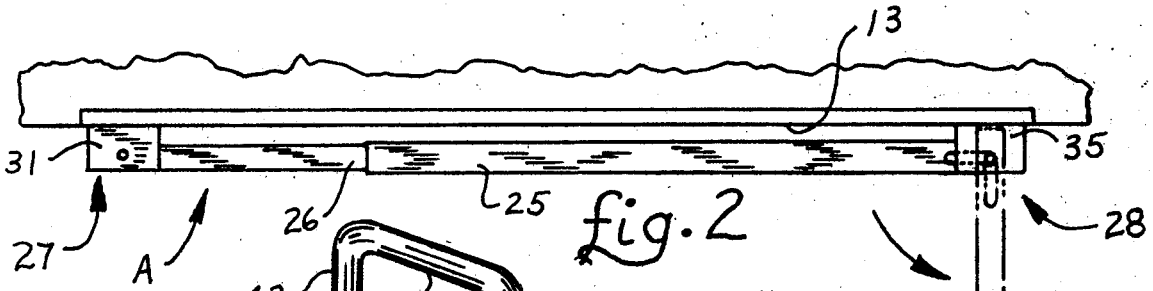
FIG. 2 is a plan view showing the device of the invention in its security position in solid lines, and in its initial position in dashed lines.
Figure 3:
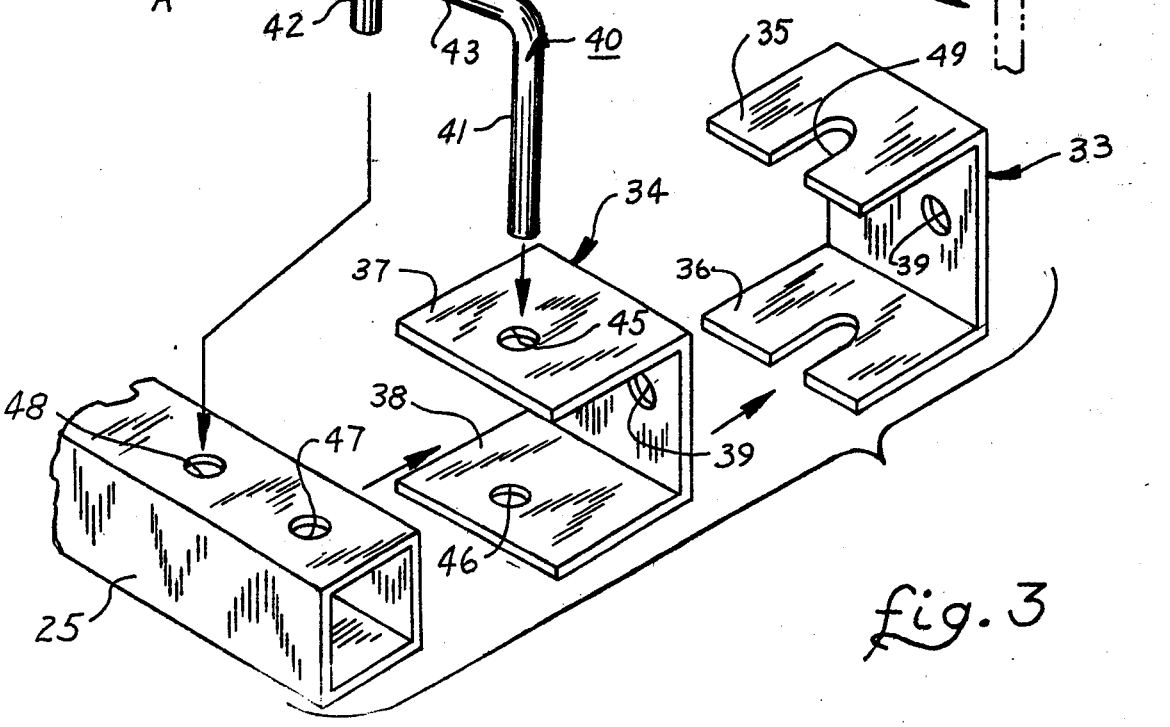
FIG. 3 is an exploded, perspective view showing the connection of the pivot end of the bar by a pivot pin to the pivot bracket of the device.

The pivot bracket assembly 28 comprises two U-shaped brackets 33 and 34 that are nested together as shown in FIGS. 1 and 2. The bracket 33 has outwardly extending, spaced, parallel flanges 35 and 36 and the inner bracket 34 likewise has outwardly extending, spaced, parallel flanges 37 and 38 (FIG. 3). The bases of the brackets each have a pair of holes 39 that are used to secure the brackets 33 and 34 in assembled relation to the frame member 12 by means of screws or the like.

The outer end of the tubular bar member 25 is secured to the bracket 34 by means of a pivot pin 40 (FIG. 3). The pivot pin 40 has a pair of parallel legs 41 and 42 connected by a central span 43. The leg 41 is adapted to extend through aligned openings 45 and 46 centrally located in the flanges 37 and 38 of the bracket 34 and also through aligned openings 47 in the end of the tubular bar member 47. This provides a pivotal connection of the security bar to the bracket assembly 28.

The other leg 42 of the pivot pin 40 extends through another hole 48 in he top of the tubular bar member 25 to lock the pin in place and prevent pivotal movement thereof relative to the tubular bar member 25.

The insertion and removal of the pivot pin 40, however, can only be accomplished when the tubular bar members are released from the locking bracket 27 and pivoted outwardly to a position generally prependicular to the wall structure, as shown in FIG. 2. In that position, the pivot pin is placed in alignment with an outwardly facing slot 49 located in the top flange 35 of the outer bracket 33. It will be noted that the top flange 35 of the outer bracket member 33 is spaced sufficiently from the top flange 37 of the inner bracket member 34 to accommodate the central span 43 of the pivot pin 40. Accordingly, once the leg 41 of the pivot pin 40 has been inserted through the openings 45, 46, and 47 of the inner bracket members 34 and the tubular bar member 25, respectively, and the other leg 42 of the pivot pin 40 has been inserted in the opening 48, through the slot 49, the bar may be pivoted from the initial position shown in dashed lines in FIG. 2 to the security position shown in solid lines in FIG. 2. In that position, the top flange 35 of the outer bracket member 33 interferes with any upward movement of the pivot pin 40, and thus prevents removal of the pivot pin 40. This likewise defeats any attempt to disconnect either the tubular bar member 25 from the bracket 28 or the screws used to connect the bracket assembly 28 to the frame member 12.

In addition to this, the connection of the pivot pin as described also prevents extension or retraction of the tubular bar member 25 relative to the tubular telescoping inner bar member 26.

While the invention has been shown and described with respect to a specific embodiment thereof, this is intended for the purpose of illustration rather than limitation, and other variations and modifications of the specific device herein shown and dscribed will be apparent to those skilled in the art all within the intended spirit and scope of the invention. Accordingly, the patent is not to be limited in scope and effect to the specific device herein shown and described, nor in any way that is inconsistent with the extent to which the progress in the art has been advanced by the invention.

What is claimed is:

1. A security device to prevent entry through windows and the like located in a wall structure, said device comprising:

a bar adapted to extend across said window and being pivotable about one end between an intial position extending outwardly from said wall structure and a security position extending generally parallel to said wall structure, locking bracket means adapted for mounting on said wall structure adjacent said window, lock means for releasably securing the other end of said bar to said locking bracket means, pivot bracket means adapted for mounting on said wall structure on the other side of said window, removable pivot pin means for pivotally connecting said one end of said bar to said pivot bracket means, and means associated with said pivot bracket means for blocking removal of said pivot pin means when said bar is in its security position while premitting removal of said pivot pin means when said bar is in its initial position.

2. A security device as defined in claim 1, wherein said bar comprises two tubular members, one telescoped within the other, whereby said bar is extensible to accommodate varying window widths.

3. A security device as defined in claim 2, wherein said lock means and said pivot pin means secure the respective outer ends of said tubular members to prevent lengthwise movement thereof relative to one another.

4. A security device as defined in claim 1, wherein said locking bracket means comprises a U-shaped member with two spaced, parallel, outwardly extending flanges adapted to receive the respective outer end of said bar therebetween.

5. A security device as defined in claim 1, wherein said pivot bracket means comprises a first U-shaped member with two spaced, parallel, outwardly extending flanges and a second U-shaped member with two spaced, parallel, outwardly extending flanges, said second member being located between said flanges of said first member and the respective end of said bar being received between the flanges of said second member.

6. Apparatus as defined in claim 5, wherein said pivot pin means extends through said flanges of said second member and through said respective end of said bar to provide a pivotal connection between said bar and second member.

7. Apparatus as defined in claim 6, wherein said means for blocking removal of said pivot pin means comprises the flange of said first member that is located over the upper end of said pivot pin means, said blocking means flange defining an opening therein that registers with said pivot pin means when said bar is pivoted to its initial position so as to permit removal of said pivot pin means from said second member.

* * * * *